United States Patent [19]

Kaminaga

[11] 4,281,477

[45] Aug. 4, 1981

[54] ROLLER-SUPPORTED CLOSURE HAVING A CLOSURE RETAINER

[75] Inventor: Hiromitsu Kaminaga, Kurobe, Japan

[73] Assignee: Yoshida Kogyo K.K., Tokyo, Japan

[21] Appl. No.: 75,025

[22] Filed: Sep. 13, 1979

Related U.S. Application Data

[63] Continuation-in-part of Ser. No. 39,120, May 15, 1979, abandoned.

[30] Foreign Application Priority Data

May 24, 1978 [JP] Japan ..... 53-69020

[51] Int. Cl.[3] ..... E05D 13/00

[52] U.S. Cl. ..... 49/453

[58] Field of Search ..... 49/453, 449, 404, 411

[56] References Cited

U.S. PATENT DOCUMENTS

| | | | |
|---|---|---|---|
| 2,699,204 | 1/1955 | Davis | 49/453 X |
| 2,937,416 | 5/1960 | Hiers | 49/449 X |
| 2,950,756 | 8/1960 | Maloney | 49/449 X |
| 3,310,914 | 3/1967 | De Klavon | 49/411 X |
| 3,650,071 | 3/1972 | Tanner | 49/411 |
| 3,714,738 | 2/1973 | Koslow et al. | 49/453 X |
| 3,854,245 | 12/1974 | Anderson | 49/449 |
| 4,054,308 | 10/1977 | Prohaska | 49/449 X |

*Primary Examiner*—Philip C. Kannan

*Attorney, Agent, or Firm*—Hill, Van Santen, Steadman, Chiara & Simpson

[57] ABSTRACT

A window or door unit comprises an outer frame, a sash or door mounted movably within the outer frame, and a sash or door removal prevention device. The device includes a blocking member supported on a header of the outer frame so as to be angularly movable between its horizontal and vertical positions. The device further includes means carried on the header for releasably retaining the blocking member in the horizontal position, whereby the sash or door can be prevented from being removed from the outer frame. When released from the retaining means, the blocking member pivots by gravity from the horizontal position to the vertical position where it is clearly visible, permitting the sash to be removed from the outer frame.

16 Claims, 14 Drawing Figures

ROLLER-SUPPORTED CLOSURE HAVING A CLOSURE RETAINER

RELATED APPLICATION

This application is a continuation-in-part application of my U.S. application Ser. No. 039,120 filed May 15, 1979, now abandoned.

BACKGROUND OF THE INVENTION

1. Field of the Invention

This invention relates generally to window and door units, and more particularly to a window or door unit which incorporates means for preventing sashes or doors from becoming accidentally detached from an outer frame on which they are slidably mounted.

2. Prior Art

Many attempts have been made to prevent a sliding window installed within an outer frame from falling out of place. To this end, it is known to mount a blocking member or retainer strip on the header of the outer frame, the blocking member being disposed within a guide groove formed in the header. This arrangement has a disadvantage in that often a workman would forget about the use or presence of such blocking member because its location is such that it cannot readily be seen.

SUMMARY OF THE INVENTION

According to this invention, a closure unit comprises an outer frame, a closure such as a sash or door mounted movably within the outer frame, and a closure removal prevention device. The device includes a bracket fixed to the header of the outer frame, and a blocking member pivotally connected at one end to the bracket. The blocking member is pivotable between its horizontal or operative position and its vertical or inoperative position. The device further includes means carried on the header for releasably retaining the blocking member in the horizontal or operative position.

It is therefore an object of the invention to provide a unit having an improved closure removal prevention device, which can prevent the workman from inadvertently failing to dispose the device in its operative position after the sash or door has been installed.

Many other advantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION OF THE PREFERRED EMBODIMENTS

Figure 1:
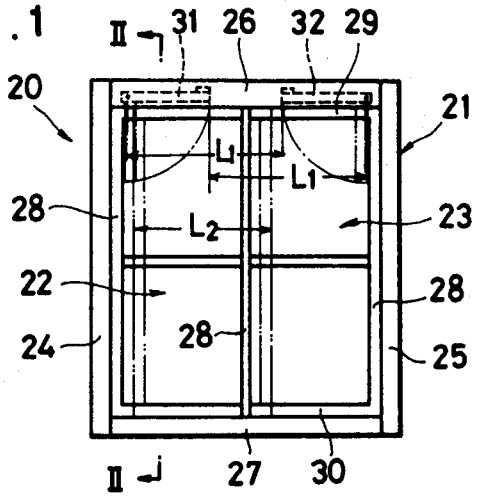
FIG. 1 is a front elevational view of a window unit having closure or sash removal prevention devices constructed in accordance with the invention.

As shown in FIG. 1, a window unit generally indicated by the numeral 20 comprises an outer frame 21 to be installed in a rough opening in a building wall (not shown), and a pair of sashes 22, 23 mounted for horizontal opening and closing movement within the outer frame 21. The outer frame 21 includes a pair of side jambs 24, 25 and a pair of header and sill members 26, 27 connected endwise to the side jambs 24, 25. Each of the sashes 22, 23 has a pair of stiles 28, 28 and a pair of top and bottom rails 29, 30 connected endwise to the stiles 29, 30. The header 26 carries a pair of sash removal prevention devices 31, 32 which are spaced remotely from each other along the header 26.

Figure 2:
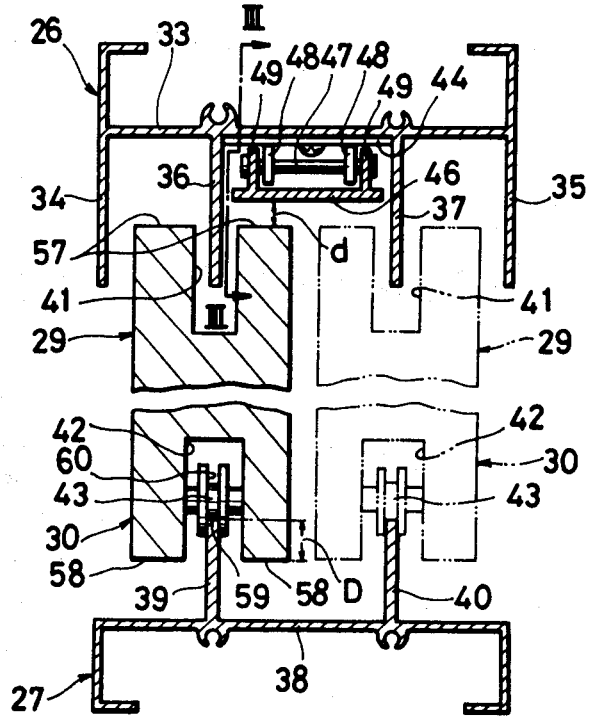
FIG. 2 is an enlarged cross-sectional view taken along line II—II of FIG. 1.

As shown in FIG. 2, the header 26 has a base plate 33, a pair of side flanges 34, 35 extending downwardly therefrom, and a pair of guide flanges 36, 37 also extending downwardly thereform. The sill 27 has a base plate 38 and a pair of rail flanges 39, 40 extending upwardly therefrom, the rail flanges 39, 40 being aligned with the guide flanges 36, 37, respectively.

Each sash 22, 23 further has a pair of top and bottom grooves 41, 42 in and formed longitudinally along the top and bottom rails 29, 30 respectively, the bottom groove 42 receiving a plurality of flanged rollers 43, only one of which is herein shown. Each of the guide flanges 36, 37 extends downwardly into one of the top grooves 41, 41 and terminates short of its bottom surface. Each of the rail flanges 39, 40 extends upwardly into one of the bottom grooves 42, 42, the rollers 43 riding on each of the rail flanges 39, 40 for horizontal rolling movement of one of the sashes 22, 23.

As shown in FIG. 2, the sash removal prevention devices 31, 32 are positioned between the guide flanges 36 and 37 and each comprises a bracket 44 fixed to the base plate 33 by a pair of machine screws 45, 45 (FIG. 3) and disposed adjacent to one of the side jambs 24, 25, and a blocking member 46 pivotally connected on its one end to the bracket 44 by means of a horizontal shaft 47. The shaft 47 extends through a pair of ears 48, 48 on the bracket 44 and a pair of side walls 49, 49 on the blocking member 46. The blocking member 46 is pivotable about the shaft 47 between its horizontal and vertical positions (FIG. 3).

Figure 3:
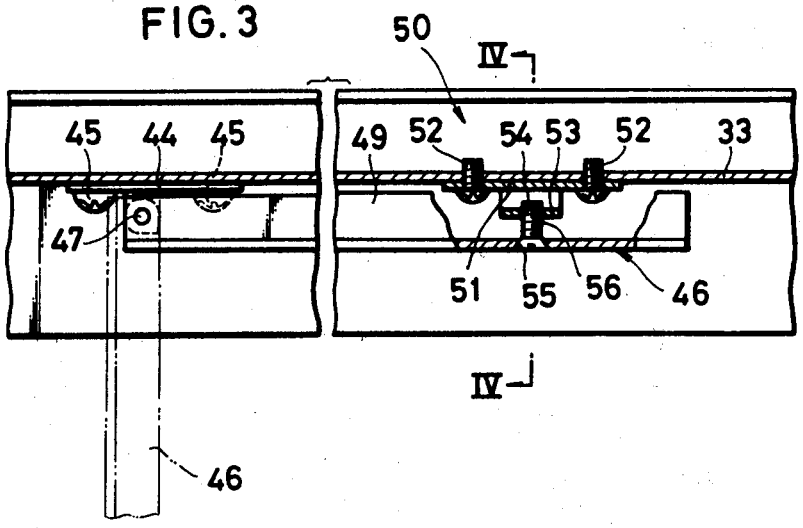
FIG. 3 is a longitudinal cross-sectional view taken along line III—III of FIG. 2, showing the sash removal prevention device with parts broken away.
Figure 4:
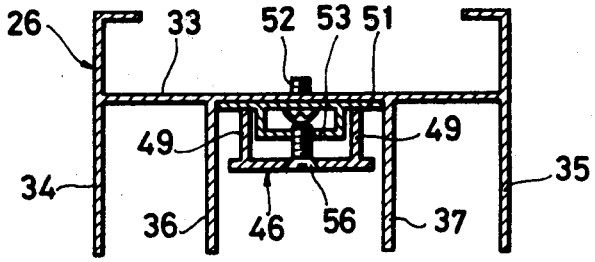
FIG. 4 is a cross-sectional view taken along line IV—IV of FIG. 3.

Each of the sash removal prevention devices 31, 32 further comprises holder means, generally designated 50 in FIG. 3, for retaining the blocking member 46 in the horizontal position. As shown in FIGS. 3 and 4, the holder means 50 includes a support member 51 fixed to the base plate 33 by a pair of machine screws 52, 52 at a position remote from the bracket 44. The support member 51 has in a portion 53 thereof a threaded hole 54, and the blocking member 46 has a countersunk hole 55 in such position that the hole 55 is vertically aligned with the threaded hole 54 of the support member 51 when the blocking member 46 is disposed in the horizontal position. A flat-headed machine screw 56 extends through the hole 55 and the threaded hole 54, retaining the blocking member 46 in the horizontal position. In this position, the blocking member 46 is disposed within a space between the guide flanges 36, 37 of the header 26, as best shown in FIG. 4. When the flat-headed machine screw 56 is removed from the threaded hole 54 of the support member 51, the blocking member 46 moves by gravity angularly about the shaft 47 from the horizontal position to the vertical position, i.e. from the solid line position to the phantom line position (FIG. 3).

The individual blocking member 46 is shorter than the width $L_2$ (FIG. 1) of the individual sash 22, 23. The opposed blocking members 46, 46 are spaced from each other such that the distance $L_1$ between a pivotal end of one of the blocking members 46, 46 and a retainable end of the other is greater than the width $L_2$ of the individual sash.

To install the sash 22 in the outer frame 21, at least one of the blocking members 46, 46 is moved to its vertical position (represented by phantom lines in FIG. 1). With the top rail 29 beneath the header 26, the sash 22 outside the outer frame 21 is inclined and is then lifted to allow the guide flange 36 to enter the top groove 41 of the sash 22. Because of a substantial space between the top edges 57 of the sash 22 and the base plate 33 of the header 26, continued upward movement of the sash 22 is possible, and the sash 22 is lifted until its bottom edges 58 can pass above an upper or distal edge 59 of the rail flange 39. With the sash 22 thus raised, the bottom rail 30 is shifted until the inner one of the bottom edges 58 clears the rail flange 39. The sash 22 is then moved downwardly to let the rollers 43 ride on the rail flange 39 with the upper or distal edge 59 of the rail flange 39 engaging an annular groove 60 in the periphery of each roller 43. During downward movement the inner bottom edge 58 of the sash 22 is shifted by a distance D with respect to the upper edge 59 of the rail flange 39. Accordingly, for removal of the sash 22 from the outer frame 21, the sash is lifted vertically from the position of FIG. 2 at least by the distance D.

After the sash 22 has been slid aside within the outer frame 21, the blocking member 46 is moved angularly about the shaft 47 from the vertical position to the horizontal position, and is fastened at its free end portion to the support member 51 by means of the flat-headed machine screw 56, retaining the blocking member 46 in the horizontal position. The sash is slid back just beneath the blocking member 46 that has been retained in place. At this time, the inner top edge 57 on the sash 22 is spaced away from the blocking member 46 by a distance d that is smaller than the distance D. Therefore, when the sash 22 is raised within the outer frame 21 for removal, the inner top edge 57 of the sash 22 engages the blocking member 46, whereby the sash 22 is prevented from being moved upwardly beyond the distance d and from falling out of the outer frame 21. With the blocking members 46, 46 thus retained, the way is clear for the sash 22 to be moved horizontally within the outer frame 21 for opening and closing the window opening.

When the machine screw 56 (FIGS. 3 and 4) is loosened and then removed from the support member 53, the blocking member 46 returns to its vertical position by gravity, permitting the sash 22 to be moved upwardly by the distance D or greater distance in the manner previously described, so that the sash 22 can be removed from the outer frame 21. Because the released blocking member 46 is disposed in its vertical position, it can be easily observed that the sash removal prevention device 31 is in an inoperative or non-prevention position. Therefore, a person attending to the installation is able without fail to connect the blocking member 46 at its free end portion to the support member 51 by the machine screw 56 after installation of the sash 22.

Figure 5:
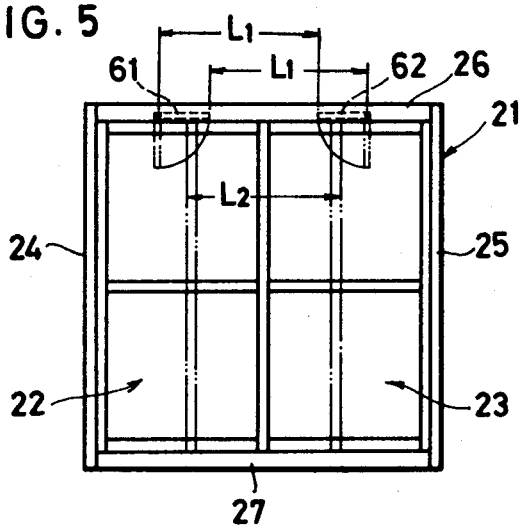
FIG. 5 is a front elevational view of a window unit according to a second embodiment of the invention.

In a second embodiment illustrated in FIG. 5, there are provided a pair of opposed sash removal prevention devices 61, 62 of the same length and each situated remotely from both side jambs 24, 25, the two devices 61, 62 being spaced such that the distance $L_1$ is greater than the width $L_2$ of the individual sash 22, 23.

Figure 6:
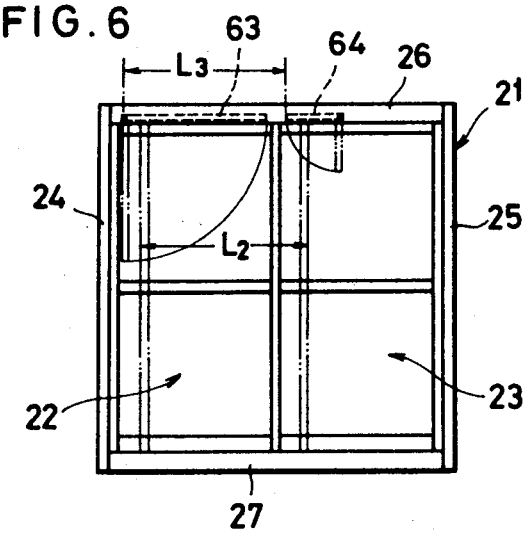
FIG. 6 is a front elevational view of a window unit according to a third embodiment.

In a third embodiment illustrated in FIG. 6, there are provided a pair of opposed sash removal prevention devices 63, 64 of different lengths, the two devices 63, 64 being so spaced from each other that the distance $L_3$ between a pivotal end of the longer device 63 and a retainable free end of the shorter one 64 is greater than the width $L_2$ of the individual sash 22, 23.

Figure 7:
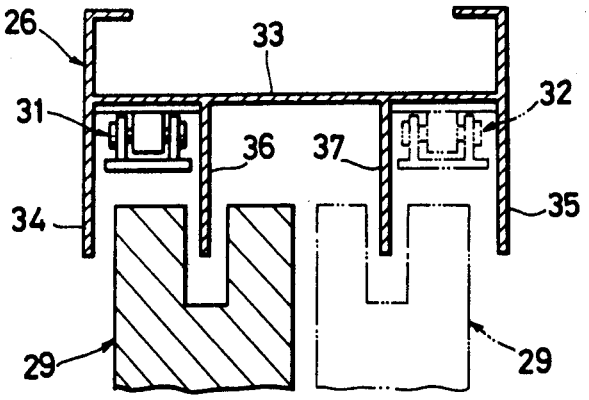
FIG. 7 is a fragmentary, enlarged cross-sectional view of a window unit according to a fourth embodiment.

In any one of the preceding embodiments, the sash removal prevention devices 31, 32 (61, 62 or 63, 64) may be positioned respectively between the side flange 34 and the guide flange 36 and between the side flange 35 and the guide flange 37, as shown in FIG. 7.

Figure 8:
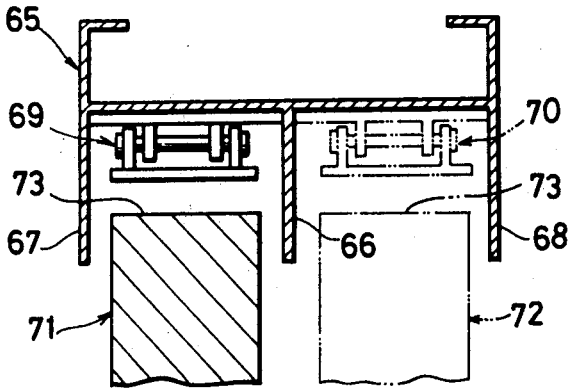
FIG. 8 is a fragmentary, enlarged cross-sectional view of a window unit according to a fifth embodiment.

FIG. 8 shows fragmentarily a modified form of outer frame, only the header member 65 of which is herein illustrated. The header 65 has a single guide flange 66 situated substantially halfway between a pair of side flanges 67, 68. A pair of sash removal prevention devices 69, 70 of the same construction as aforementioned are disposed between the side flange 67 and the guide flange 66 and between the latter and the side flange 68, respectively, for preventing a pair of sashes 71, 72 from disengaging from the outer frame. Unlike the sashes 22, 23 in the preceding embodiments, the sashes 71, 72 have no top grooves in their top edges 73, 73.

Figure 9:
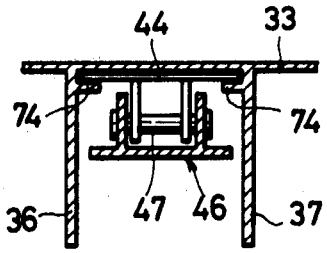
FIGS.9 through 12 are cross-sectional views illustrating modified forms of the sash removal prevention device.
Figure 10:
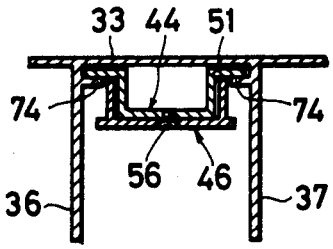

As shown in FIG. 9, the bracket 44 (FIG. 2) of the individual sash removal prevention device 22,23 may be supported by a pair of tongues 74,74 on the guide flanges 36,37. The two tongues 74,74 extend horizontally from the respective guide flanges 36,37 toward each other and terminate short thereof, each tongue being spaced from the base plate 33 to an extent sufficient to receive therebetween the bracket 44. To fix the bracket 44 in position, the tongues 74,74 are simply deformed toward the base plate 33. Likewise, the support member 51 (FIG. 3) also may be supported by the horizontal tongues 74,74 on the guide flanges 36,37, as shown in FIG. 10.

Figure 11:
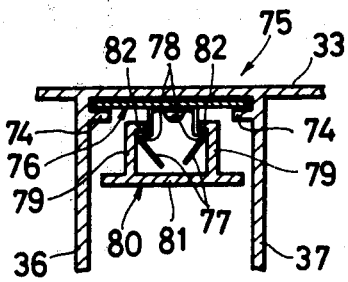
Figure 12:
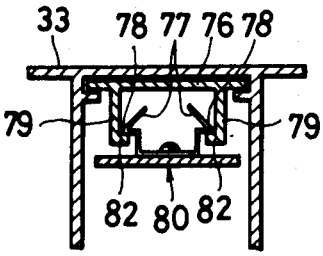

FIG. 11 illustrates a modified form of holder means generally designated at 75, in which a support member 76 essentially includes a pair of resilient legs 77,77 each having a protuberance 78. The two protuberances 78,78 are engageable with a pair of hook legs 79,79 on a blocking member 80, each hook leg extending perpendicularly from a base 81 and terminating in an inwardly directed end 82. Alternatively, the resilient legs 77,77 may be carried on the blocking member 80, and the support member 76 may include the hook legs 79,79, as shown in FIG. 12.

Any of the foregoing embodiments may be modified to have the closure members supported on rollers from which the closure members depend, and the flanged rollers riding on rail flanges may be modified to be rollers riding between double-flanged rails. Exemplary illustrations include such a modification of FIG. 2 in FIG. 13, and of FIG. 8 in FIG. 14.

Figure 13:
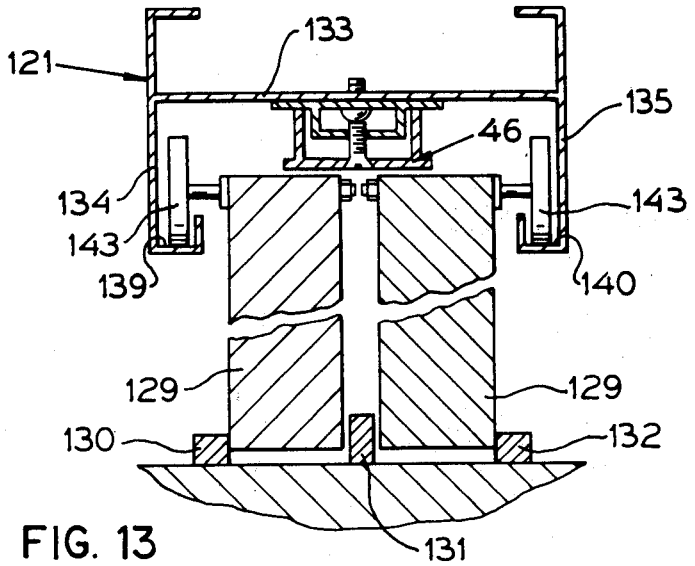
FIG. 13 is a cross-sectional view of a door unit having a closure or door removal prevention device according to the invention.

As shown in FIG. 13, the header of a closure unit includes an outer frame 121 having a pair of horizontal double-flanged rail surfaces 139,140 carried by a pair of spaced flanges 134,135 extending downwardly from a horizontal base plate 133 thereof. A pair of closure members 129,129 each have a pair of rollers 143,143 by which said members are movably mounted on and suspended from said rail surfaces 139,140. Normally there would be sufficient clearance above the rollers 143,143 to enable them to be lifted off the flanged rail surfaces 139,140. However, a blocking member 46 of the type described in FIG. 2 functions similarly in this embodiment. A number of conventional fixed guides 130–132 are at the lower edges of said closure members 129,129 to restrict movement thereof to a direction parallel to said flanges 134,135.

Figure 14:
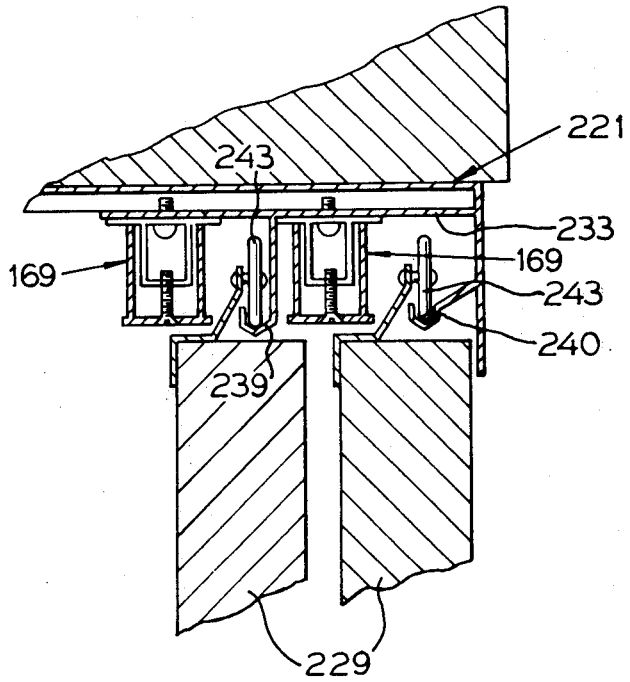
FIG. 14 is a cross-sectional view of a further form thereof.

As shown in FIG. 14, the header of a closure unit includes an outer frame 221 having a pair of double-flanged rail surfaces 239,240 extending downwardly from a horizontal base plate 233 thereof. A pair of closure members 229,229 each have a pair of rollers 243,243 by which said members are movably mounted on and suspended from said rail surfaces 239,240. Normally there would be sufficient clearance above the rollers 243,243 to enable them to be lifted off the flanged rail surfaces 239,240. However, a blocking member 169 of the type described in FIG. 8, but appropriately proportioned, functions similarly in this embodiment.

Although various minor modifications may be suggested by those versed in the art, it should be understood that I wish to embody within the scope of the patent warranted thereon all such embodiments as reasonably and properly come within the scope of my contribution to the art.

I claim as my invention:

1. A closure unit for a building wall opening comprising, in combination:

(a) a frame adapted to be installed in the opening and including a header for being disposed at the upper part of the opening, said header having a horizontal base plate and at least one flange extending downwardly from said base plate;

(b) a closure member within said frame and having a pair of rollers movably mounting said member on a horizontal rail surface on said frame in an axially trapped manner, said closure member being disposed adjacent to said flange and having a clearance between its upper edge and said base plate enabling the closure member to be raised sufficiently to enable said rollers to be placed on and to be removed from the rail surface;

(c) a blocking member pivotably supported on said header and pivotable between a first horizontal position and a second vertical position, said blocking member when in said first position being situated above and spaced from said upper edge of said closure member by a distance that is somewhat less than said clearance, said closure member being thereby confined to upward movement for said distance within said frame and being thereby prevented from being removed from said frame; and (d) means on said header for releasably retaining said blocking member in said first position, said blocking member, when released from said retaining means, being angularly movable by gravity to said second position in which said blocking member permits said closure member to be lifted well into said clearance for removal from said frame.

2. A closure unit according to claim 1, including a bracket secured to said base plate and providing the pivotal support for said blocking member at one end thereof for movement about a horizontal axis between said positions.

3. A closure unit according to claim 1, said retaining means including a support member carried on said base plate, said support member having a threaded hole into which a fastener screw may extend, said blocking member having a hole through which the last-mentioned fastener screw may extend.

4. A closure unit according to claim 1, said blocking member having a pair of spaced hook legs, said retaining means including a pair of spaced resilient legs engageable with said hook legs.

5. A closure unit according to claim 1, said retaining means including a pair of spaced hook legs, said blocking member carrying a pair of spaced resilient legs engageable with said hook legs.

6. A closure unit according to claim 1, the pivotal support of said blocking member being at a position adjacent to one end of said header.

7. A closure unit according to claim 1, the pivotal support of said blocking member being at a position remote from opposite ends of said header.

8. A closure unit according to claim 1, comprising a further pivotably supported blocking member and a further retaining means for the same, such two blocking members being oppositely disposed to each other.

9. A closure unit according to claim 8, the pivoted end of one of said two blocking members and a free end of the other being spaced from each other to an extent greater than the width of said closure members.

10. A closure unit according to claim 8, said two blocking members being equal in length.

11. A closure unit according to claim 8, said two blocking members being different in length.

12. A closure unit comprising, in combination:

(a) an outer frame adapted to be installed in an opening in a building wall and including a header and a sill, said header having a base plate and a pair of spaced first flanges extending downwardly from said base plate, and said sill having a guide rail extending upwardly;

(b) a closure member mounted movably within said outer frame and including a pair of top and bottom rails, said bottom rail having a bottom groove receiving a distal edge of said guide rail, the distal edge being spaced a first distance from a bottom edge of said bottom rail;

(c) a blocking member pivotably supported on said header between said first flanges and pivotable between a first horizontal position and a second vertical position, said blocking member when in said first position being situated above and spaced from a top edge of said top rail by a second distance that is smaller than said first distance, said closure member being thereby confined to upward movement for said second distance within said outer frame and being prevented against being removed from said outer frame; and (d) means on said header between said first flanges for releasably retaining said blocking member in said first position, said blocking member, when released from said retaining means, being angularly movable by gravity to said second position in which said blocking member permits said sash to be lifted at least by said first distance for removal from said outer frame.

13. A closure unit according to claim 12, including a bracket carried on said base plate between said first flanges and providing the pivotal support for said blocking member.

14. A closure unit according to claim 12, said header further having a pair of second flanges extending downwardly from said base plate and interposed between said first flanges.

15. A closure unit according to claim 14, said blocking member and said retaining means being situated between said second flanges.

16. A closure unit according to claim 14, said blocking member and said retaining means being situated between one of said first flanges and one of said second flanges.

* * * * *